United States Patent [19]

Brochand

[11] 4,441,430

[45] Apr. 10, 1984

[54] AERIAL MONOCABLE TRANSPORT INSTALLATION

[75] Inventor: Max Brochand, Noyarey, France

[73] Assignee: Pomagalski S.A., Fontaine, France

[21] Appl. No.: 334,078

[22] Filed: Dec. 24, 1981

[30] Foreign Application Priority Data

Jan. 9, 1981 [FR] France ..... 81 00432

[51] Int. Cl.[3] ..... B61B 12/12

[52] U.S. Cl. ..... 104/209; 104/211; 104/216; 104/224

[58] Field of Search ..... 104/202, 204, 205, 206, 104/209, 211, 216, 217, 220, 224

[56] References Cited

U.S. PATENT DOCUMENTS

| | | | |
|---|---|---|---|
| 3,610,164 | 10/1971 | Feuz | 104/211 X |
| 3,785,296 | 1/1974 | Berry et al. | 104/202 |
| 3,857,340 | 12/1974 | Wright | 104/216 X |
| 3,871,303 | 3/1975 | Woodling | 104/209 X |
| 4,120,247 | 10/1978 | Muller et al. | 104/216 X |
| 4,297,951 | 11/1981 | Laurent | 104/209 |

FOREIGN PATENT DOCUMENTS

| | | | |
|---|---|---|---|
| 1005103 | 3/1957 | Fed. Rep. of Germany | 104/211 |
| 2343636 | of 0000 | France . | |
| 2036543 | of 0000 | France . | |
| 2250654 | 6/1975 | France | 104/209 |

OTHER PUBLICATIONS

French Republic Search Report.

*Primary Examiner*—Robert B. Reeves
*Assistant Examiner*—David F. Hubbuch
*Attorney, Agent, or Firm*—Parkhurst & Oliff

[57] ABSTRACT

Aerial monocable chairlift or gondola lift having detachable grips for coupling the chairs or gondolas to the continuously moving cable. Each grip, in the form of a plier, has a pair of jaws, the outer profile of the jaws being so designed that the grip passes on support sheaves, hold down sheaves and horizontal wheels in the station. The clamping coil spring is inserted between the ends of the plier levers and extends substantially parallel to the hanger bar articulated on the grip body. A grip operating roller opens the jaws at a platform in the station and the speed of the chair is reduced for loading and/or unloading of the passengers before the grip is again coupled to the cable.

1 Claim, 6 Drawing Figures

10
16
18
20
24
28
30
32
34
36
36'
44
46
52
56

AERIAL MONOCABLE TRANSPORT INSTALLATION

The invention relates to a monocable transport installation such as a chairlift or a gondolalift and in particular to a detachable grip for coupling a carriage supporting a load on to the overhead cable. The grip is the most vital component of such a transport installation because the safety and success of the entire system is dependent upon the quality of the clamping device. In a known aerial ropeway of the endless monocable type the detachment of the gondola or chair to the continuously moving traction cable is executed during the entrance of the gondola into the station and the carriage runs on transfer rails towards the exit of the station to be coupled to the cable in a manner well known per se. The station further comprises side rails for stocking the chairs or gondolas during the rest periods, more particularly during the night. The grip does not pass the horizontal bull wheel and the grip mechanism is not exposed during the night to snow and ice which could prevent closing of the grip and reliable coupling to the cable. These systems are complicated and the object of the present invention is to provide for a simplified installation and for a detachable grip which may remain fixed to the cable during the travel over the horizontal terminal wheel as well as during the night.

Another object of this invention is to provide for a detachable grip allowing substantial opening of the clamping members and having spring means to insure a positive grip on the cable under variation in its size. It is further essential that the grip can travel over all supporting sheaves and also pass the various hold-down sheaves.

In another prior chair lift the grips are permanently fixed to the continuously operating cable at short distances from another and the passengers are loaded and unloaded while the chairs travel at high speed, but such loading and unloading can create accidents. The grips are provided with an opening mechanism for slippage of the grips on occasion but that mechanism is unable to uncouple the chair from the cable at each passage of a station. Further the spring is enclosed within a cartridge and the ice may lock the grip.

According to the present invention, means are provided in each station for opening the grip so as the chair may travel at low speed or may be stopped for loading and unloading while the cable is continuously running. The grip can be lifted from the cable or the cable may run between the opened jaws of the grip and after acceleration of the chair the grip is reclosed on to the cable. The grip coupled to the cable travels around the horizontal bull wheel and the conventional transfer rails, stocking rails and drive means in the station are unnecessary.

Further objects and advantages of the invention will appear more clearly from the following detailed specification and annexed drawings in which.

Figure 1:
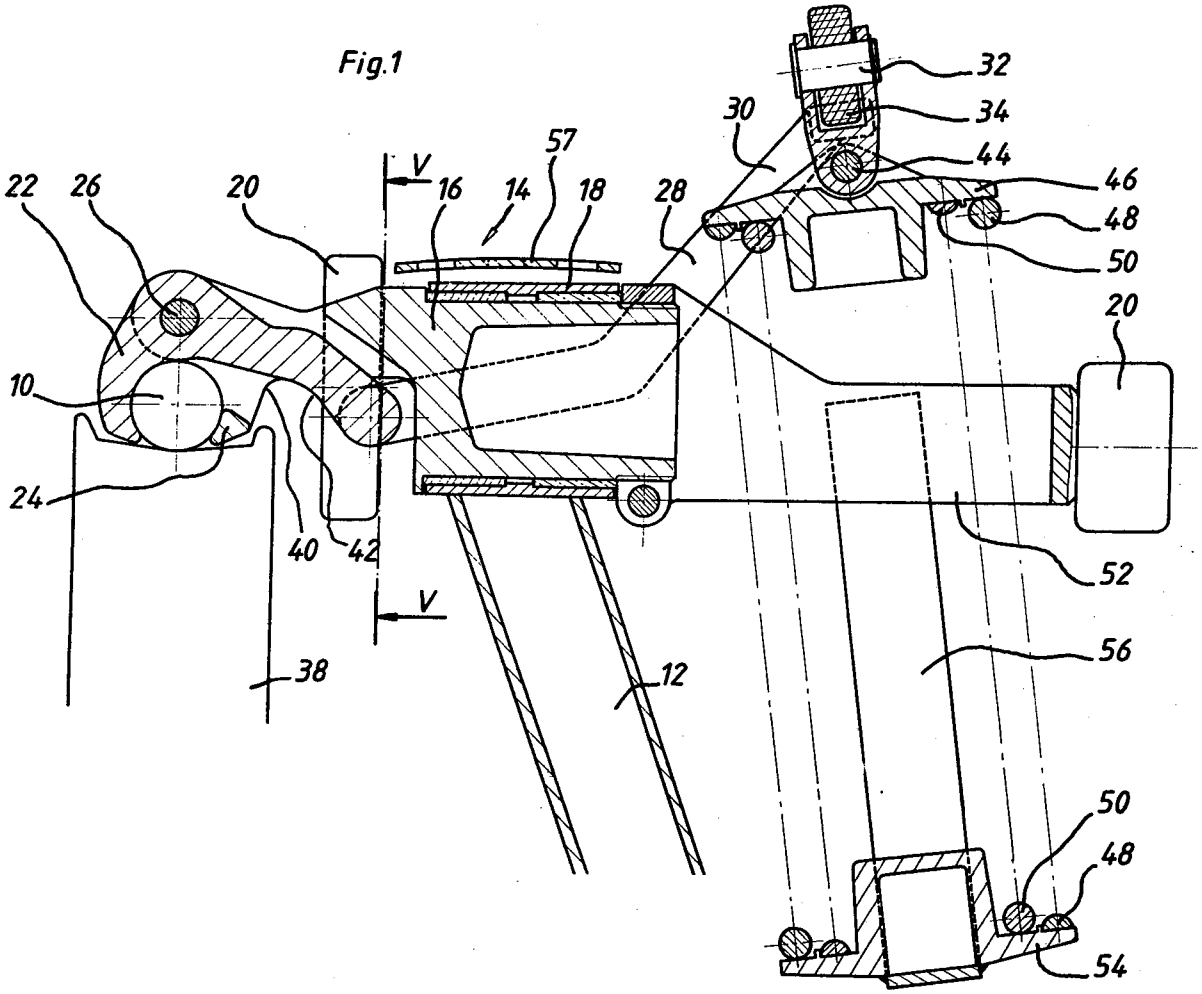
FIG. 1 is a longitudinal cross section of a grip according to the invention, shown in the closed position.

With reference to the drawings, a continuously running cable 10 of an aerial monocable transport installation, in particular a gondola or chair lift, passes over numerous supporting sheaves 38 and hold down sheaves. A horizontal wheel 11, situated in each of the two terminal stations 13, guides the continuously operating cable 10 around to proceed back in the opposite direction. A number of cable grips 14 are fixed to the cable at short distances from one another and each grip 14 carries a chair 15 or a gondola by means of a hanger bar 12. The chairs 15 travel along an arrival and/or departure platform 17 in the station 13 where the grip 14 is uncoupled from the cable for loading and/or unloading of the passengers. The uncoupled grip is adapted to ride on tracks for lifting the grip from the cable or for supporting the opened grip while the running cable passes between the separated jaws.

The grip 14 includes a grip body 16 in the form of a shaft extending horizontally and transversely on one side of the cable 10 when the grip is in the coupled position. One end of the grip body 16 is provided with a stationary or fixed jaw or clamp 24 and with a spindle 26 which pivotally connects a movable jaw or clamp 22. The fixed jaw has a U-shaped jaw end arm and the movable jaw extends in between said end arm. In the position illustrated in FIG. 1, the movable jaw 22 coacts with the stationary jaw 24 to grip the cable 10, the spindle 26 extending in the vertical plane of the cable 10 and above the latter. The movable jaw 22 is located on the outer side of the cable 10 which engages the horizontal wheel 11 and its length is shorter than the length of the stationary inner jaw 24. The grip body 16 further includes wheels 20 which are adapted to ride on tracks (not shown) which extend along the cable travel path in the station 13. One or a pair of wheels 20 are located near the jaws 22, 24 and another wheel 20 is secured to the opposite end of the grip body 16. A chair hanger bar 12 is hinged to the grip by means of a bushing 18 surrounding a portion of the grip body 16 near said one wheel 20. The movable jaw 22 has an operating shank 28 extending substantially parallel to the grip body 16 and having U-shaped arms 36, 36' surrounding the grip body 16 which extends in between said arms 36, 36'. The end 30 of the operating shank 28 supports on an axis 32 a roller 34 which travels along a guide rail (not shown) located within the station 13 along the platform 17. It will be appreciated that when the shank 28 is moved downwards, to the position shown in FIG. 2, the movable jaw 22 associated therewith will be pivoted to the opened position against the action of a spring 48, 50 thereby releasing the grip from the cable 10. The stationary jaw 24 has an arcuate outer portion that engagingly encompasses little more than one-half of cable 10 while the movable jaw 22 has an arcuate inner surface that engages about the remaining half of the cable 10, so that the grip 14 can travel over the supporting sheaves 38 and pass the hold down sheaves (not shown) substantially free from shocks. The length of the outer movable jaw 22, which engages the horizontal wheel 11 liner, is short so as to reduce the cable flexion.

It will be seen that the jaws 22, 24 together with the grip body 16 and the operating shank 28 form a plier allowing substantial opening of the jaws and producing sufficient clamping force.

Opposite to the roller 34 the end 30 of the operating shank 28 carries a disc washer 46 pivotally mounted on an axis 44. Two coaxial coil springs 48, 50 are inserted between disc washer 46 and a disc washer 54 rigidly secured by means of a bracket 56 to the grip body 16. The springs 48, 50 extend freely substantially parallel with hanger 12 in a generally vertical direction and pass through an opening 52 provided in the grip body 16. The stroke of the spring system is sufficient for urging the movable jaw 22 towards the stationary jaw 24 and for enabling substantial opening of the jaws 22, 24 by the roller 34 running on the guide rail at the platform 17.

OPERATION

Figure 2:
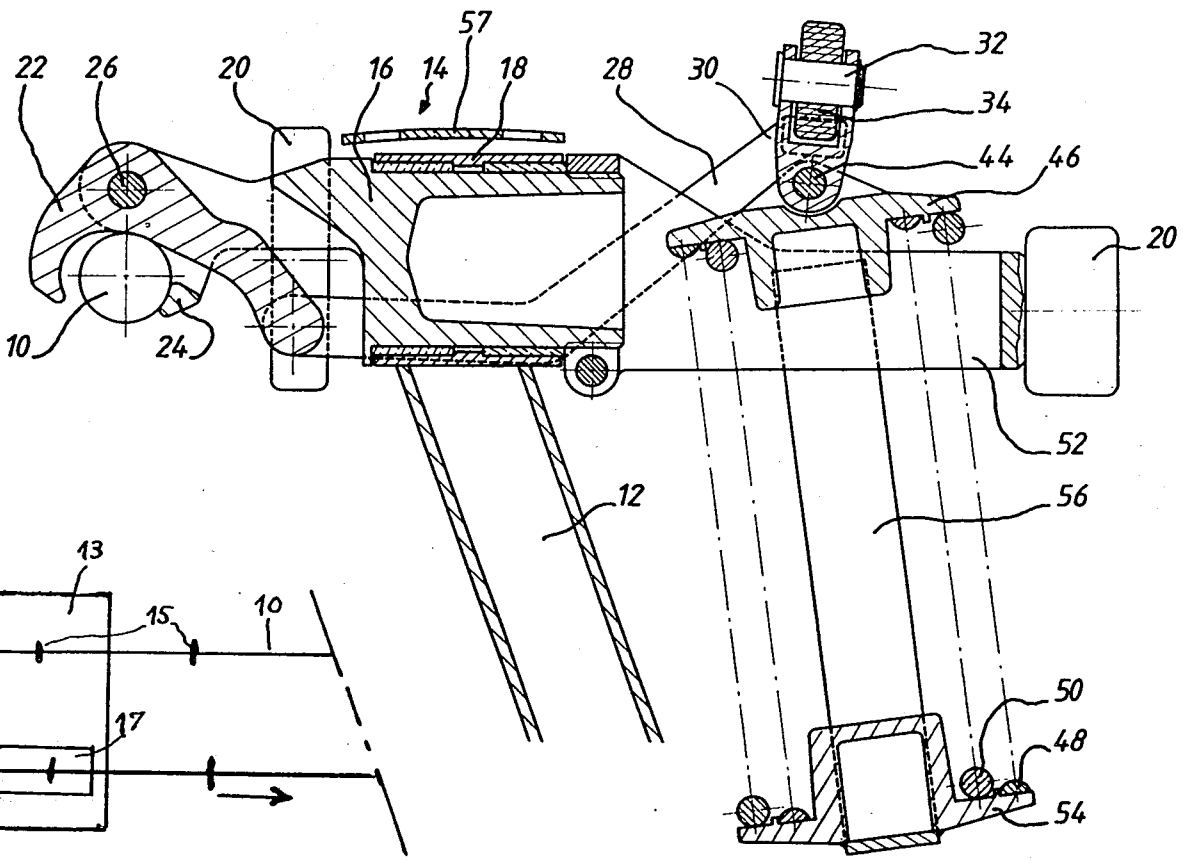
FIG. 2 is a view similar to FIG. 1, showing the grip in the opened position.
Figure 6:
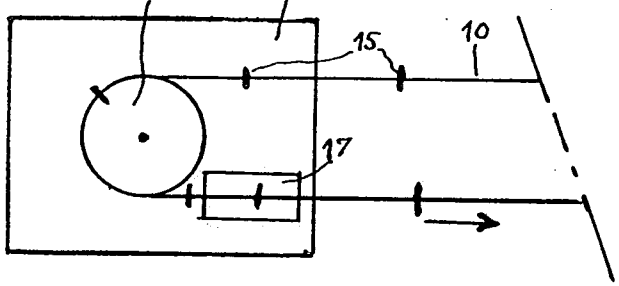
FIG. 6 is a plan view of the terminal station.
Figures 3, 4, 5:
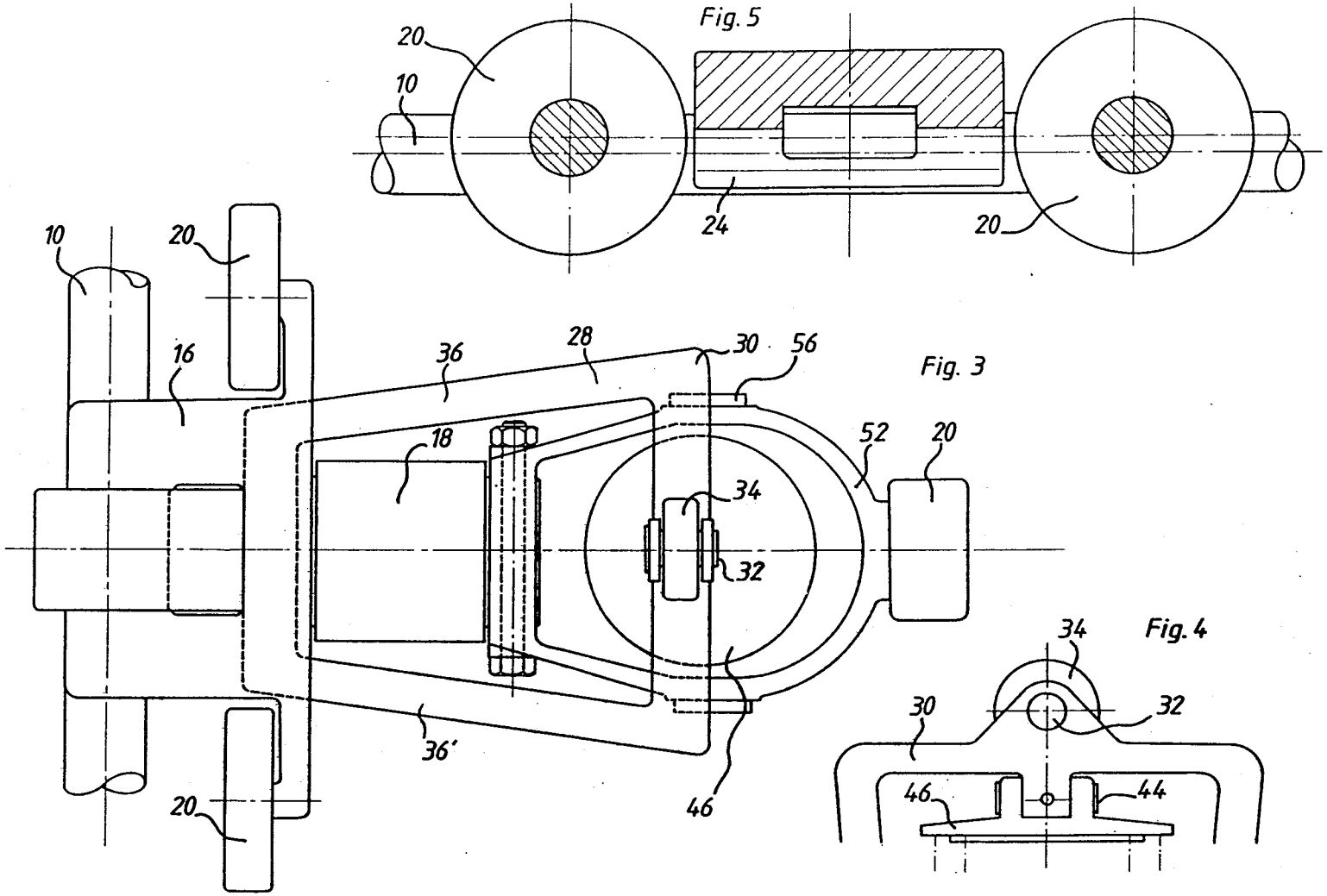
FIG. 3 is a plan view of the grip.
FIG. 4 is an end view showing the end of the control lever of the grip.
FIG. 5 is a section on the line V—V of FIG. 1, the movable jaw being omitted.

In the coupled or clamped position shown in FIG. 1, the jaws 22, 24 are pressed against the cable 10 by the pressure of springs 48, 50 acting on grip levers formed by the grip body 16 and the operating shank 28. The grips 14 are coupled to the cable 10 at short distances from one another and pass the support sheaves 38, the hold down sheaves and in the station 13, the horizontal wheel 11. At the entrance of platform 17 the wheels 20 run on tracks for supporting the grip 14 and the associated chair 15, and the roller 34 cooperates with a guide rail to move the operating shank 28 downwards about the pivotal connection 26 against the action of springs 48, 50 for opening the jaws 22, 24. The uncoupled grip 14 is braked in a well known manner for unloading and/or loading of the passengers and thereafter the grip 14 is accelerated and coupled to the cable 10 at the exit of platform 17 when the roller 34 leaves the guide rail. The chairs uncoupled from cable 10 run substantially along the same path as the cable on platform 17, but at a reduced speed. Of course, the following chair 15 must be sufficiently spaced for preventing collision with the uncoupled chair on the platform 17. The spring and grip system provides substantial opening of the jaws 22, 24 to allow the cable 10 to run between the separated jaws 22, 24. Braking and acceleration of the uncoupled grip may be provided by wheels (not shown) frictionly acting on a plate 57 secured to the upper side of the grip body 16. The roller 34 acts directly on to springs 48, 50 and the operating stroke may be as great as necessary.

The springs 48, 50 are not housed inside a cartridge or a housing and the grip does not have nesting arrangements which may cause icing of the grip during the night and failure of the clamp. Flexion of the cable on the passage of the grip 14 over the horizontal wheel 11 does not provoke an opening of the jaws 22, 24 and uncoupling of the grip. The portions 40, 42 of the grip body 16 and of the operating shank 28, near the fixed jaw 24, are shaped so as to respect the gauge necessary for a monocable installation. In the opened position of the jaws 22, 24 the portion 42 of the operating shank 28 protrudes downwardly for engagement of the support means (not shown) of the derailed cable and for maintaining the jaws in the clamping position.

I claim:

1. An aerial monocable transport installation having a continuously operating cable, a horizontal wheel situated in the terminal station and guiding the cable around, a loading platform situated in the station along the travel path of the cable and detachable grips for clamping chairs or gondolas to the cable, each grip comprising:

an inner fixed jaw and an outer movable jaw the outer movable jaw engaging with said horizontal wheel when the grip travels around said wheel, a spring urging the movable jaw towards the fixed jaw in a cable clamping position, a grip body positioned when the grip is coupled on to the cable substantially horizontal and lateral on one side of the cable, support wheels for supporting the uncoupled grip at said loading platform, a hanger bar pivotally mounted on said grip body for supporting the chair or gondola, and a control mechanism including an operating shank having one end rigidly secured to the movable jaw, said shank extending substantially parallel to the grip body and carrying control means on its opposite end, said jaws when closed being substantially flush with the bottom surface of said cable and forming only limited projections on the top and on the side opposite to the grip body of said cable, said spring being disposed laterally substantially parallel to the hanger bar and acting on said opposite end of the operating shank for producing sufficient clamping force and for allowing substantial opening of the jaws, said spring being a freely disposed coil spring extending through an opening provided in the grip body at a point located between the hanger bar pivot and a support wheel secured to the end of the grip body opposite to the jaws, said coil spring being inserted between the end of the operating shank and a support bracket rigidly secured to the grip body.

* * * * *